US007636995B2

(12) United States Patent
Oku

(10) Patent No.: US 7,636,995 B2
(45) Date of Patent: Dec. 29, 2009

(54) METHOD OF MANUFACTURING A LIQUID EJECTION HEAD

(75) Inventor: Seiichiro Oku, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 347 days.

(21) Appl. No.: 11/516,546

(22) Filed: Sep. 7, 2006

(65) Prior Publication Data

US 2007/0052764 A1 Mar. 8, 2007

(30) Foreign Application Priority Data

Sep. 8, 2005 (JP) ..... 2005-260901

(51) Int. Cl.
*B41J 2/045* (2006.01)

(52) U.S. Cl. ..... 29/25.35; 29/890.1; 29/593; 347/71; 347/72

(58) Field of Classification Search ..... 29/25.35, 29/890.1, 854, 593, 407.05, 407.07; 347/50, 347/68, 70, 71, 72
See application file for complete search history.

(56) References Cited

U.S. PATENT DOCUMENTS 4,008,619 A * 2/1977 Alcaide et al. ..... 29/593 X
5,940,947 A * 8/1999 Takeuchi et al. ..... 29/25.35
6,068,367 A 5/2000 Fabbri
6,332,254 B1 * 12/2001 Usui et al. ..... 29/25.35

FOREIGN PATENT DOCUMENTS

JP 04294151 A * 10/1992 ..... 29/890.1 X
JP 06023980 A 2/1994
JP 07-186386 A 7/1995
JP 2003326723 A 11/2003

* cited by examiner

*Primary Examiner*—A. Dexter Tugbang
(74) *Attorney, Agent, or Firm*—Birch, Stewart, Kolasch & Birch, LLP

(57) ABSTRACT

The method of manufacturing a liquid ejection head includes the steps of: forming piezoelectric elements on a diaphragm; stacking an intermediate plate which includes recess sections for covering the piezoelectric elements and drive wires connected to the piezoelectric elements, on the diaphragm; connecting an integrated circuit to the drive wires; forming an actuator function unit by electrically and mechanically bonding the diaphragm, the piezoelectric elements, the drive wires, the intermediate plate and the integrated circuit, in such a manner that the piezoelectric elements are electrically driven via the integrated circuit; measuring displacement of the diaphragm by operating the integrated circuit; and bonding a flow path forming member to the actuator function unit after the step of measuring the displacement of the diaphragm, the flow path forming member being provided for forming pressure chambers connected to nozzles and forming a common liquid chamber for storing liquid supplied to the pressure chambers.

6 Claims, 12 Drawing Sheets

METHOD OF MANUFACTURING A LIQUID EJECTION HEAD

BACKGROUND OF THE INVENTION

1. Field of the Invention

The present invention relates to a method of manufacturing a liquid ejection head, and an image forming apparatus. In particular, the present invention relates to a method of manufacturing a liquid ejection head in which a plurality of liquid ejection ports (nozzles) are two-dimensionally arranged densely, and to an image forming apparatus, such as an inkjet recording apparatus, which can form an image on a recording medium by using such a liquid ejection head.

2. Description of the Related Art

An inkjet recording apparatus causes ink droplets to be deposited on a recording medium by, in response to an image signal, ejecting inks from a recording head (print head) provided with nozzles for ink ejection, while relatively moving the recording head and the recording medium, and thereby an image is formed by means of thus obtained ink dots.

A general recording head has a structure for supplying inks to pressure chambers communicated with nozzles and driving drive elements for the pressure chambers (pressure generating element each constituted from a piezoelectric element or a heating element, for example), thereby applying pressure fluctuation to the liquid inside the pressure chamber and ejecting droplets from the nozzles.

Recently, formation of high-quality images such as picture-quality images has been desired in the field of inkjet printing, and there has been carried out an attempt at realization of outputting an image with high resolution by reducing the sizes of ejected droplets and densifying the arrangement of the nozzles.

Japanese Patent Application Publication No. 7-186386 discloses an inkjet printing apparatus having a structure in which a plurality of short head modules are in the form of staggered arrangement and attached to a frame. This inkjet printing apparatus comprises a reservoir for which each of the modules can hold an ink refill section, and whereby ejection of inks performed by each module can be examined prior to assembling the modules.

Japanese Patent Application Publication No. 6-23980 discloses an inkjet recording apparatus in which an electrode substrate formed below a diaphragm is constituted from a transparent substrate and electrodes which are patterned on the transparent substrate are also constituted from transparent conducting layers. Specifically, Japanese Patent Application Publication No. 6-23980 proposes that, by using the transparent electrode substrate and electrodes, and using a light measurement technology such as a laser Doppler method, measurement of a displacement of the diaphragm is performed. According to the technology disclosed in Japanese Patent Application Publication No. 6-23980, ejection properties can be evaluated without pouring inks into the heads.

Japanese Patent Application Publication No. 2003-326723 discloses a method of examining an actuator apparatus, the method being characterized in applying predetermined voltage to a piezoelectric element under a drivable condition and executing a step of measuring the electrostatic capacity, thereby discriminating its characteristics.

Inkjet heads with high record density (high dpi), particularly line heads, are in the form of an extremely multi-element arrangement, and thus the arrangement of the elements and wirings are highly dense. In general steps of manufacturing an inkjet head, the electrical connection of the elements (piezoelectric elements or thermal elements) inside the head (connection between each element and a circuit such as a drive IC including a switch IC) is formed at a stage in the vicinity of the final step. For example, at the final stage of the step in which the duct structure body is built up, a step for connection of a FPC (flexible printed card) and connection of the IC, or the like, is performed.

In the above-mentioned step of electrical connection, if one of thousands of elements is in poor connection, all of the head may become defective. Even if the heads are not defective, if irregularities in the characteristics of the elements are significant, image degradation such as image unevenness occurs. Thus, it is necessary to precisely evaluate the characteristics of each element.

In this regard, in the general manufacturing steps, after the electrical connection step, ink is actually filled in the head, ejection of the ink is performed, and evaluation based on the electrical connection, IC, ink duct, pressure chamber and the like is carried out.

According to the technology disclosed in Japanese Patent Application Publication No. 7-186386, evaluation is performed for each module, but it is the same as the related arts in that the evaluation is conducted by filling inks and performing actual ejection.

According to the technology disclosed in Japanese Patent Application Publication No. 6-23980, the substrate and electrodes are made transparent in order to optically detect a movement (displacement) of the diaphragm; however, the transparent substrate and transparent conducting materials are not commonly used, and thus these transparent substrate and materials may be inferior to the general substrate and electrodes in terms of costs and electrical characteristics.

The technology disclosed in Japanese Patent Application Publication No. 2003-326723 is used for electrically measuring the characteristics of the elements; however, the mechanical factors of the elements (for example, the state of attachment of the piezoelectric elements) are not reflected in a result of the measurement.

Moreover, in the electrical connection step, relatively high temperature or high pressure is mostly required in general. For example, in the case of a soldering technique, the temperature is approximately 250° C. or more, and in the case of an ACF (anisotropic conductive film) technique, the temperature is approximately 150° C. or more and the pressure to be applied is approximately 1 N or more per one terminal. According to such a general manufacturing method in which the electrical connection step using relatively high temperature and high pressure is performed at the end, high temperature and high pressure are applied to the pressure chamber which is formed prior to the electrical connection step. Therefore, there is a possibility in which the dimensional accuracy of the pressure chamber, and the like, is deteriorated due to such history of the temperature and pressure.

In the case of a multi-element inkjet head, provision of a sensor in the pressure chamber in order to sense the pressure and improve reliability is proposed; however, in such a case, it is not desirable to apply high temperature to the sensor configured with a resin or the like, and to the wiring for the sensor.

SUMMARY OF THE INVENTION

The present invention is contrived in view of such circumstances, and an object thereof is to provide a method of manufacturing a liquid ejection head and an image forming apparatus which can evaluate the characteristics of an element without filling or ejecting liquid, use a material which can be produced at low costs and has excellent electrical characteristics, and avoid deterioration of the dimensional accuracy caused by high temperature and high pressure.

In order to attain the aforementioned object, the present invention is directed to a method of manufacturing a liquid ejection head, the method comprising the steps of: forming a plurality of piezoelectric elements on a diaphragm; stacking an intermediate plate which includes recess sections for covering the piezoelectric elements and drive wires connected to the piezoelectric elements, on a surface of the diaphragm on which the piezoelectric elements are formed, in such a manner that peripheral spaces are formed around the piezoelectric elements by means of the recess sections and electrical connections are created between the drive wires and the piezoelectric elements; connecting an integrated circuit to end sections of the drive wires which are opposite to connection sections between the drive wires and the piezoelectric elements; forming an actuator function unit by electrically and mechanically bonding the diaphragm, the piezoelectric elements, the drive wires, the intermediate plate and the integrated circuit after the formation of the piezoelectric elements on the diaphragm, the stack of the intermediate plate on the diaphragm, and the connection of the integrated circuit and the drive wires, in such a manner that the piezoelectric elements are electrically driven via the integrated circuit; measuring displacement of the diaphragm by operating the integrated circuit in the actuator function unit; and bonding a flow path forming member to the actuator function unit after the measurement of the displacement of the diaphragm, the flow path forming member being provided for forming a plurality of pressure chambers connected to a plurality of nozzles and forming a common liquid chamber for storing liquid supplied to the pressure chambers.

According to this aspect of the present invention, an "actuator function unit" in which a diaphragm, piezoelectric elements, an intermediate plate, drive wires, and an IC are combined and electrically connected is formed so that the piezoelectric elements can be driven in this state of the unit. Furthermore, before integrating the actuator function unit with pressure chambers and a flow path forming member including a common liquid chamber, the drive characteristics of the piezoelectric elements are evaluated for each unit. Hence, even if there is a defect in the actuator function unit, the entire head do not become defective and the yield of production of the entire heads is improved. Moreover, the characteristics of the piezoelectric elements and the diaphragm can be examined and evaluated without filling the inside the head with the liquid or actually ejecting the liquid, and thus the examination (measurement), and the analysis and evaluation of the examination can be performed relatively easily.

Moreover, according to this aspect of the present invention, the displacement of the diaphragm can be measured directly, and thus it is not necessary to use special materials such as a transparent material, and a general material can be used. Therefore, material costs and production costs can be kept low, and materials which have excellent electrical characteristics can be selected.

Further, according to this aspect of the present invention, an electrical connection step is finished when the actuator function unit is completed, and thus it is not necessary to apply high temperature and high pressure to the flow path forming member for the pressure chamber in the subsequent steps, and the deterioration of the dimensional accuracy caused by the high temperature and the high pressure can be avoided.

Preferably, the flow path forming member includes a pressure chamber forming member for forming the pressure chambers and a common liquid chamber forming member for forming the common liquid chamber; and the flow path forming member is bonded to the actuator function unit in such a manner that the pressure chamber forming member is bonded to a diaphragm side of the actuator function unit and the common liquid chamber forming member is bonded to an intermediate plate side of the actuator function unit.

According to this aspect of the present invention, the pressure chamber forming member is bonded to the diaphragm side of the actuator function unit, and the common liquid chamber forming member is bonded to the opposite side (intermediate plate side). Specifically, the common liquid chamber is formed on the opposite side across the diaphragm from the pressure chambers. According to this structure, the pressure chambers (or liquid droplet ejection ports communicated thereto) can be arranged densely.

Preferably, the actuator function unit includes liquid flow paths penetrating through the intermediate plate and the diaphragm in such a manner that the pressure chambers are connected to the common liquid chamber via the liquid flow paths.

According to this aspect of the present invention, the liquid can be supplied directly from the common liquid chamber to the pressure chambers through the liquid flow paths formed so as to penetrate through the actuator function unit. Thus, the flow path resistance of the liquid supply paths can be reduced. Accordingly, even in the case of highly viscous liquid, the sufficient amount of the supplied liquid can be secured and improvement of the refill properties can be achieved.

Preferably, the method further comprises the step of performing evaluation of a liquid sealing property of the actuator function unit by bringing the actuator function unit into contact with a conductive liquid, before the flow path forming member is bonded to the actuator function unit.

When the actuator function unit contacts with the liquid due to the structure of the liquid ejection head, it is preferred to perform an examination for checking whether the drive wires and/or piezoelectric elements of the actuator function unit are not in contact with the liquid.

Preferably, the method further comprises the step of correcting at least one of a diameter of a liquid droplet ejection port and a diameter of each of liquid supply paths connected to the pressure chambers according to the measured displacement of the diaphragm.

As an aspect in which a result of the drive evaluation is used, as described above, by adjusting the cross-sectional area of each of the liquid droplet ejection ports or of each of the liquid supply paths so as to compensate the characteristics of the actuator function unit, irregularity of the ejection performance of the entire head can be reduced.

Preferably, the method further comprises the step of correcting resistance values of the drive wires according to the measured displacement of the diaphragm.

In order to attain the aforementioned object, the present invention is also directed to an image forming apparatus comprising a liquid ejection head manufactured by one of the methods of manufacturing a liquid ejection head as defined above.

An inkjet recording apparatus as one aspect of the image forming apparatus according to this aspect of the present invention, includes a liquid ejection head (a recording head) in which a plurality of liquid droplet ejection elements (ink chamber units) arranged densely. Each of the liquid droplet ejection elements includes: a liquid droplet ejection port (nozzle) from which an ink droplet is ejected for forming a dot; and a pressure generating device (piezoelectric element) which generates the ejection pressure. Moreover, the inkjet recording apparatus further comprises an ejection controlling device which controls the ejection of the liquid droplets from the liquid ejection head on the basis of ink ejection data (dot image data) generated from an input image. According to the inkjet recording apparatus, an image is formed on a recording medium by means of the liquid droplets ejected from the nozzles.

As an embodiment of the configuration of such a liquid ejection head used for printing, a full-line type head in which a plurality of nozzles are arranged throughout the length corresponding to the entire width of the recording medium can be used. The full-line type head is normally disposed so as to extend in a direction perpendicular to a relative feed direction (relative conveyance direction) of the recording medium; however, there is also a mode in which the head is disposed in an oblique direction with a predetermined angle, with respect to the direction perpendicular to the conveyance direction.

When a color image is formed by a liquid ejection head (recording head) of an inkjet printing system, a plurality of the heads may be provided and the head may be respectively disposed for a plurality of ink colors, or one head capable of ejecting a plurality of colors of inks may be disposed.

The "recording medium" is a medium which receives adhesion of liquid ejected from a nozzle of a liquid ejection head, and a medium, such as a piece of recording paper, corresponds to the recording medium in the image forming apparatus. Specifically, the "recording medium" can be referred to as a print medium, an image-formed medium, a recorded medium, an image receiving medium, an ejection receiving medium, and the like, and includes various media, regardless of the materials and shapes, such as a continuous paper, a cut paper, a sealing paper, a resin sheet such as an OHP sheet, a film, a fabric, a printed board on which a wiring pattern or the like is formed, an intermediate transfer medium.

A conveyance device which relatively moves the recording medium and the liquid ejection head, includes a mode in which the recording medium is conveyed to a stopped (fixed) head, a mode in which the head is moved to a stopped recording medium, and a mode in which both the head and recording medium are moved.

When a color image is formed by using the inkjet head, the recording heads may be respectively disposed for a plurality of ink colors (recording liquid colors), or one head capable of ejecting a plurality of colors of inks may be disposed.

The present invention can be applied not only to the full-line type head but also to a shuttle scan type recording head (a recording head that performs deposition of the droplets while reciprocating in a direction which is approximately perpendicular to the conveyance direction of the recording medium).

According to the present invention, the characteristics of the piezoelectric elements and the substrate can be evaluated easily without performing the filling with the liquid and the ejection of the liquid. Moreover, the yield of production of the entire heads can be improved. Further, according to the present invention, special materials, such as transparent materials, are not required, and thus general materials can be used. Therefore, material costs and production costs can be kept low and materials having excellent electrical characteristics can be selected.

Moreover, according to the present invention, the electrical connection step requiring high temperature and high pressure is performed in a process of forming the actuator function unit (carried out before the bond of the flow path forming member). Thus, deterioration of the dimensional accuracy of the pressure chambers and the like, which is caused by the high temperature and the high pressure, can be avoided.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS

Constructional Embodiment of a Liquid Ejection Head

First of all, a constructional embodiment of an inkjet head (corresponding to the "liquid ejection head") which is produced through the method of manufacturing a liquid ejection head according to an embodiment of the present invention, is described.

Figure 1:
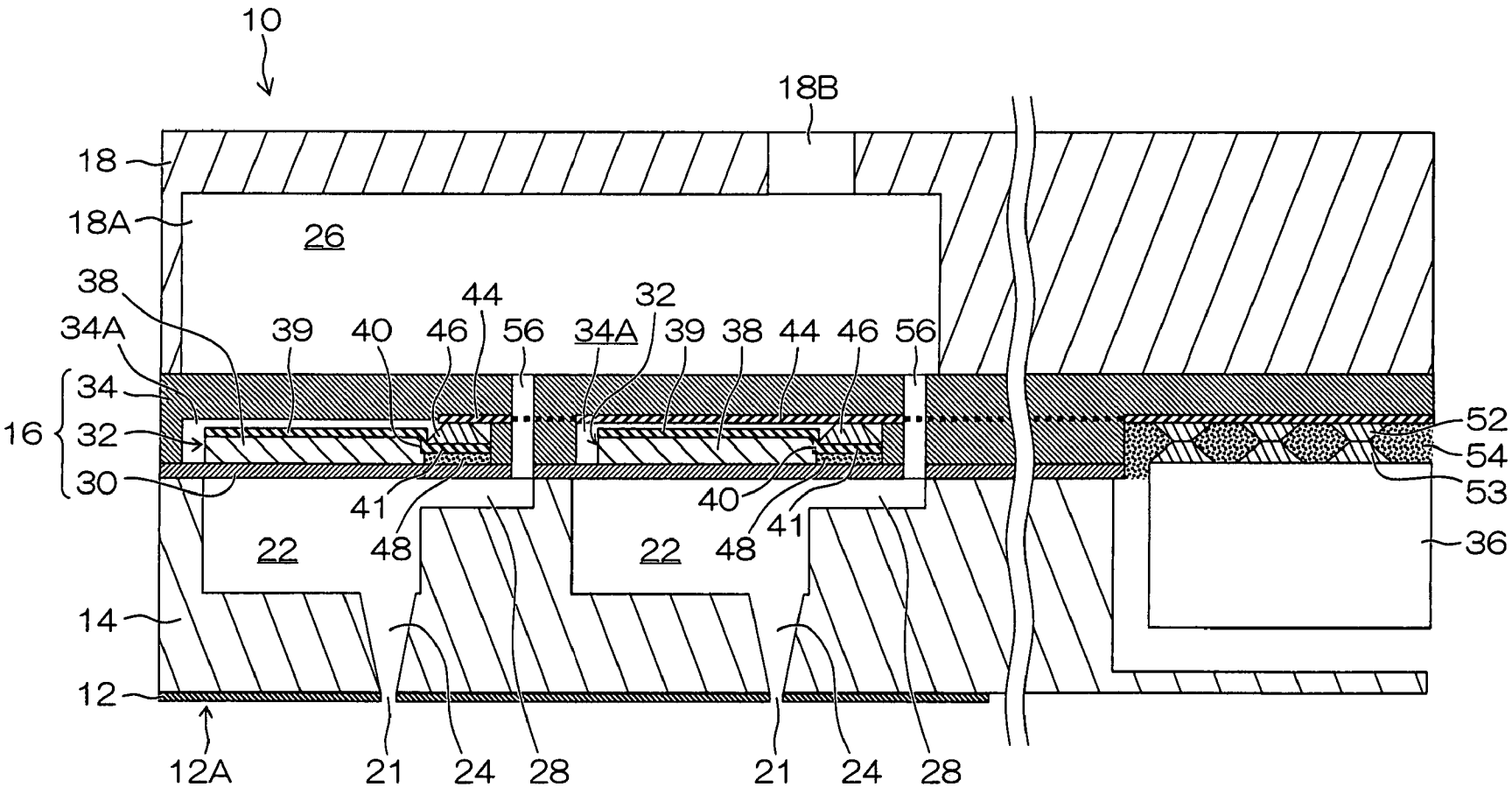
FIG. 1 is a cross-sectional view showing a structure of an inkjet head which is produced in the method of manufacturing a liquid ejection head according to an embodiment of the present invention.
Figure 2:
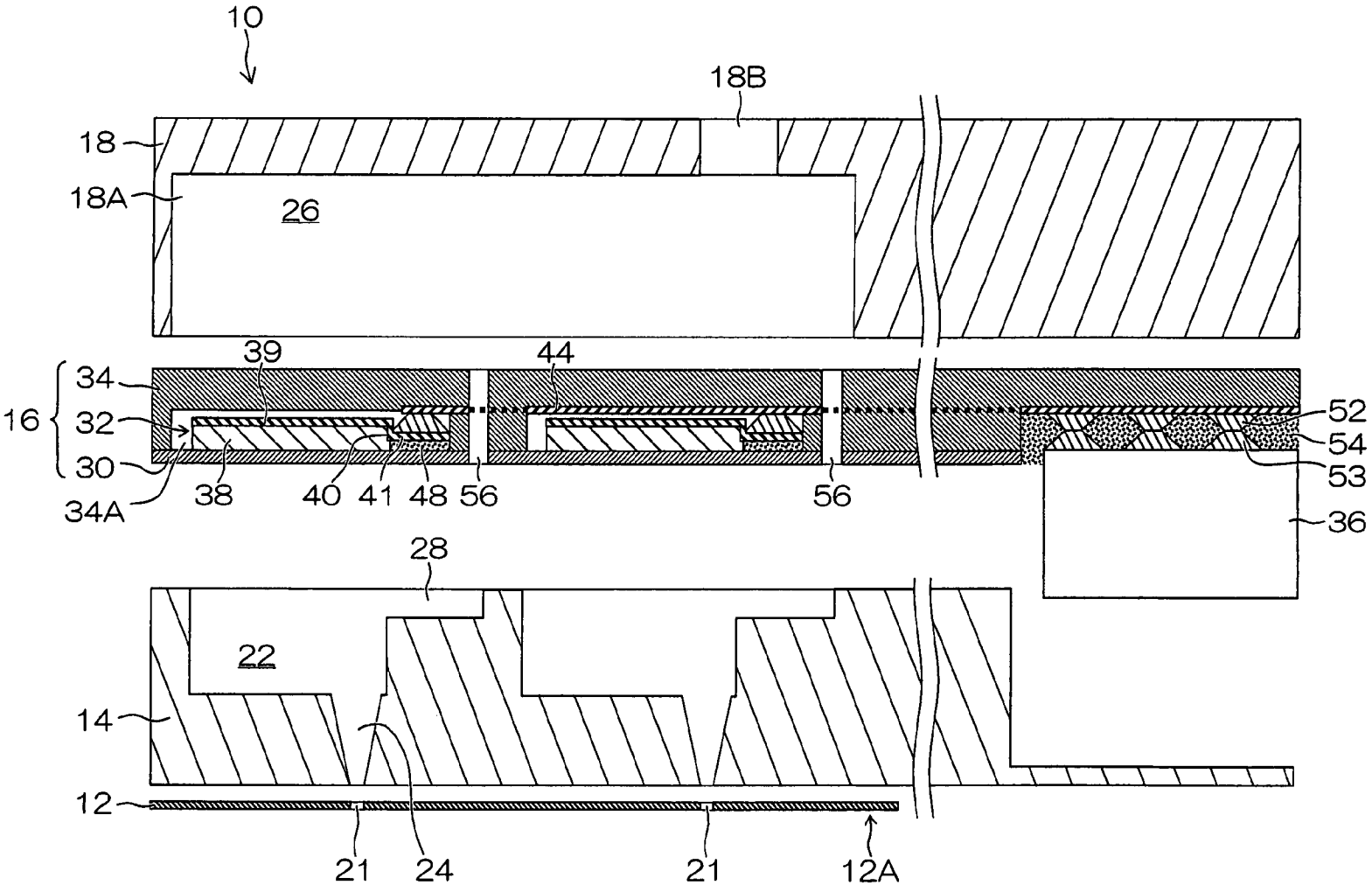
FIG. 2 is an exploded view of the inkjet head shown in FIG. 1.

FIG. 1 is a cross-sectional view showing a structure of the inkjet head according to the present embodiment. FIG. 2 is an exploded view showing the elements of components in an understandable manner.

As shown in FIGS. 1 and 2, the inkjet head 10 according to the present embodiment is constituted from a layer structure in which a nozzle plate 12, a pressure chamber forming member (corresponding to the "flow path forming member") 14, an actuator function unit 16, and an ink pool forming member (corresponding to the "flow path forming member" and "common liquid chamber forming member") 18 are bonded to one another.

A plurality of holes of nozzles 21, which correspond to ink ejection ports, are formed in the nozzle plate 12. From the perspective of ejection stability and improving cleaning properties for cleaning an ejection surface (nozzle surface 12A), the nozzle surface 12A is provided with a liquid repellent layer (not shown). A method of providing liquid repellency to the nozzle surface 12A (a method for liquid-repelling process) is not particularly limited, and thus there are, for example, a method of applying a fluorocarbon liquid repellent material and a method of depositing, in vacuo, a liquid repellent material made of fluorocarbon polymer particles (PTFE), and thus a thin layer is formed on the surface thereof.

The pressure chamber forming member 14 is a flow path forming member in which spaces for pressure chambers 22, communication paths (nozzle flow paths) 24 extending from the pressure chambers 22 to nozzles 21, and a part of individual supply paths 28 which each lead an ink from an ink pool (corresponding to the "common liquid chamber") 26 on the ink supply side to the pressure chamber 22 are formed.

The pressure chamber forming member 14 may be constituted with a single plate member in which predetermined flow path-shaped sections (an opening, groove, or the like) are formed, or may be constituted with a layered body in which a plurality of plate members which are formed with openings or grooves (recess sections) for forming the predetermined flow path-shaped sections, are stacked on and bonded to one another.

The actuator function unit 16 is a structure body in which a diaphragm 30, a piezoelectric element 32, an intermediate plate 34, and a drive IC (corresponding to the "integrated circuit") 36 are combined to form a unit. The diaphragm 30 is a member which configures a partial surface of the pressure chamber 22 (top surface in FIG. 1), is made from a conducting member such as stainless steel (SUS), and also functions as a common electrode of the plurality of piezoelectric elements 32. It should be noted that a mode of forming the diaphragm using a non-conducting material such as a resin is also possible, in which case a common electrode layer made of a conducting material such as metal is formed on the surface of the diaphragm.

On an opposite surface of the diaphragm 30 from the pressure chamber 22 (i.e., upper side surface of the diaphragm 30 in FIG. 1), piezoelectric bodies 38 are provided at positions corresponding to the pressure chambers 22, and an individual electrode 39 is formed on an upper surface of each piezoelectric body 38 (surface which is opposite to the surface abutting against the diaphragm 30 which also functions as the common electrode). A piezoelectric element (piezoelectric actuator) 32 is configured by the individual electrode 39, the common electrode (functioning as the diaphragm 30) opposite thereto, and the piezoelectric body 38 lying between these electrodes. As the piezoelectric body 38, piezoelectric materials, such as lead zicronate titanate and barium titanate, can be suitably used.

A feeder wiring 40 connects the individual electrode 39 of each piezoelectric element 32 to a side of the piezoelectric body 38 (to the outside of the piezoelectric active section), and a flat section (pad) 41 of the feeder wiring 40 is formed with a bump 46 for the connection with an electric wiring (corresponding to the "drive wire") 44. It should be noted that an insulating layer 48 is provided between the flat section 41 of each feeder wiring 40 and the diaphragm 30.

The intermediate plate 34 is a wiring board which comprises the electric wiring 44 connected to the individual electrodes 39 of the piezoelectric elements 32, and at the same time functions as a spacer covering an upper part of the piezoelectric element 32 while securing a displacement space of the piezoelectric element 32. Originally the piezoelectric element 32 causes a deflection deformation in a thickness direction or a change in the thickness direction and thereby displaces the diaphragm 30. Therefore, a space for tolerating such deformation is necessary in the upper part above the piezoelectric element 32. Specifically, recess sections 34A corresponding to the piezoelectric elements 32 is formed in the intermediate plate 34, and predetermined spaces are made in peripheral sections around the piezoelectric elements 32 by these recess sections 34A.

Furthermore, the intermediate plate 34 is provided with the electric wiring (internal wiring) 44 which is patterned in a predetermined shape. This electric wiring 44 is formed along a bottom layer of the recess section 34A (i.e., along a top surface facing an upper surface of the individual electrode 39 in FIG. 1).

One end of the electric wiring 44 is electrically connected to an individual electrode 39 via the bump 46 as described above. The other end of the electric wiring 44 is led to an end section of the inkjet head 10 (right end in FIG. 1) and electrically connected to the drive IC 36 via bumps 52 and 53.

It should be noted that the bumps indicated with the reference numeral 52 are formed on the electric wiring 44 side on the intermediate plate 34 (and are also called "wiring side bumps"), and the bumps indicated with the reference numeral 53 are formed on the drive IC 36 side (and are also called "IC side bumps"). Further, an insulating resin (underfill resin) 54 is filled around the connection sections between the bumps 52 and 53.

A connection pattern between the individual electrode 39 of each piezoelectric element 32 and the electric wiring 44 is not limited to the above embodiment. For example, a bump may be formed directly on the individual electrode 39 on each piezoelectric body 38 to create a connection between the electric wiring 44 and the individual electrode 39 without providing the feeder wiring 40. Moreover, in FIG. 1, the flat section 41 of each feeder wiring 40 is provided at a position (height) which is one step below the electrode surface of the individual electrode 39; however, the both may be placed on the same level without providing such step (i.e., the flat section 41 of the feeder wiring 40 may be formed on the same level as the individual electrode 39).

The intermediate plate 34 in the present embodiment is a member configuring a partial surface of the ink pool 26 (a floor wall member configuring a bottom surface of the ink pool 26 in FIG. 1). In order to supply ink to each pressure chamber 22 from the ink pool 26, holes (i.e., ink flow paths 56 which correspond to the "liquid flow paths") which penetrates through the intermediate plate 34 and the diaphragm 30 are formed in relation to the positions of the pressure chambers 22. The ink flow paths 56 are formed approximately perpendicularly to a surface of the diaphragm 30, and the ink pool 26 and pressure chambers 22 are communicated with each other via the ink flow paths 56.

It should be noted that, from the perspective of resistance to liquid, an insulating protection film (not shown) which is configured from a resin or the like is formed on the section on a surface of the intermediate plate 34 which makes contact with the ink inside the ink pool 26.

An ink pool forming member 18 is bonded to an upper surface of the intermediate plate 34 (to the opposite surface of the intermediate plate 34 from the diaphragm 30). The ink pool forming member 18 is a flow path forming member (wall member) which comprises a recess section 18A for forming a space for the ink pool 26 storing ink to be supplied to each pressure chamber 22.

The reference numeral 18B represents a supply system connection port for introducing the ink into the ink pool 26, and an ink tank is connected to this supply system connection port 18B via a required channel (not shown in FIG. 1).

The ink pool forming member 18 may be constituted with a single plate member in which predetermined flow path-shaped sections (an opening, groove, and the like) are formed, or may be constituted with the layered body in which a plurality of plate members which are formed with an opening and a groove (recess section) for forming the predetermined flow path-shaped section, are stacked on and bonded to one another.

According to the inkjet head 10 configured as described above, by causing the drive IC 36 to be operated and applying drive voltage between an individual electrode 39 and the common electrode (functioning as the diaphragm 30), the piezoelectric element 32 is deformed and the capacity of the pressure chamber 22 changes, and thereby the ink is ejected from the nozzle 21 due to a change in pressure caused by the deformation and the change. After the ink ejection, when the displaced piezoelectric element 32 returns to the original shape and the original position, new ink is refilled into the pressure chamber 22 from the ink pool 26 through the ink flow path 56.

As described above, because of the structure in which the ink pool 26 is disposed above the diaphragm 30 (opposite side of the diaphragm from the pressure chamber 22) and the ink is supplied to a lower pressure chamber 22 through the ink flow path 56 which runs approximately perpendicularly to the surface of the diaphragm, the resistance of the flow path on the supply side can be reduced and the ink refill properties can be improved.

The ink pool 26 described here is one large space which is formed throughout the entire region in which the pressure chambers 22 are formed, so as to supply ink to all pressure chambers 22. However, the ink pool 26 is not necessarily formed as one space, and thus a plurality of ink pools 26 which are allocated to several divided regions may be formed for the pressure chambers 22. The ink pool 26 may also have a predetermined flow path structure which can regulates flows of inks.

According to the inkjet head 10 of the present embodiment, highly dense nozzle arrangement can be realized, improvement of the refill properties can be achieved, and, even in the case of using relatively highly viscous liquid (approximately 20 cP through 50 cP, for example), sufficient amount of supplied liquid can be secured.

Method of Manufacturing the Liquid Ejection Head

Next, an embodiment of the method of manufacturing the ink ejection head according to an embodiment of the present invention is described. FIGS. 3A through 3L show a method of producing the inkjet head 10 described with reference to FIG. 1 and FIG. 2. The inkjet head 10 in this embodiment is manufactured according to the following procedure (steps 1 through 12).

Step 1: Step of Forming Piezoelectric Bodies on the Diaphragm

Figure 3A:
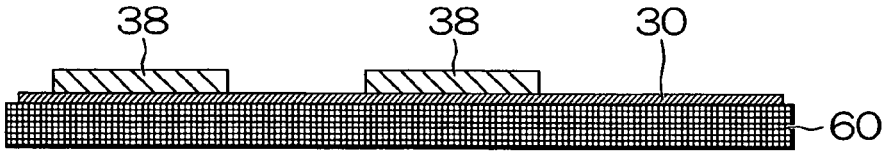
FIGS. 3A to 3L are figures showing steps of manufacturing the inkjet head according to an embodiment of the present invention.

As shown in FIG. 3A, first, piezoelectric bodies 38 are formed on the diaphragm 30. It should be noted that, in the subsequent steps, it is preferred that the assembly be temporarily bonded onto some sort of a holding member for holding the pressure chamber forming member 14 to carry out the steps until a step of bonding of the pressure chamber forming member 14 (FIG. 3J) is performed. This is because each member itself is extremely thin and that handling in and between the steps is difficult. However, for the convenience of explanation, a holding member 60 is described only in FIG. 3A, and the holding member 60 is not illustrated in the subsequent figures in order to simplify the figures.

Step 2: Individual Electrode Formation Step

Figure 3B:
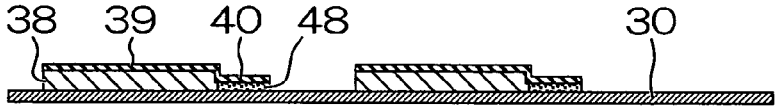

Next, as shown in FIG. 3B, an individual electrode 39 is formed on the upper surface of each piezoelectric body 38, and the insulating layer 48 and feeder wiring 40 for each piezoelectric body 38 are formed. In the present embodiment, the above Steps 1 and 2 correspond to the piezoelectric element formation step.

Step 3: Bump Formation Step

Figure 3C:
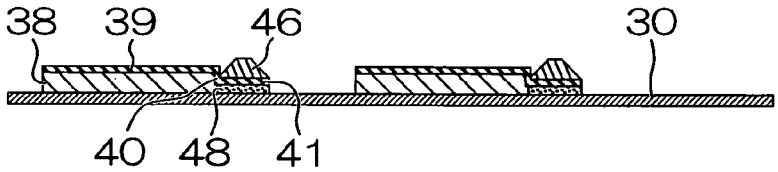

Thereafter, as shown in FIG. 3C, a bump 46 is formed on each flat section 41 of the feeder wiring 40.

Step 4: Step of Stacking First Intermediate Sheet

Figure 3D:
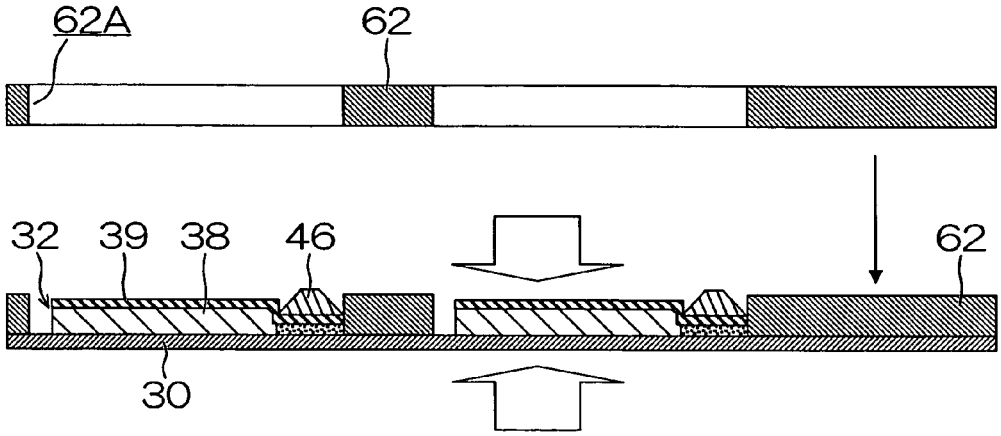

Subsequently, as shown in FIG. 3D, a first intermediate sheet 62 is stacked on the diaphragm 30, heated and pressurized at a predetermined temperature and pressure, and bonded onto the diaphragm 30. This first intermediate sheet 62 is a spacer which has openings 62A (sections equivalent to the recess sections 34A described in FIG. 1) for securing displacement spaces for the piezoelectric elements 32, and constitutes the intermediate plate 34 together with a resin wiring sheet (second intermediate sheet) 64, which is described hereinafter. The first intermediate sheet 62 has a predetermined thickness so that a predetermined space is formed above the individual electrode 39 of each piezoelectric element 32 when the resin wiring sheet (second intermediate sheet) 64 is stacked on the first intermediate sheet 62.

Figure 3E:
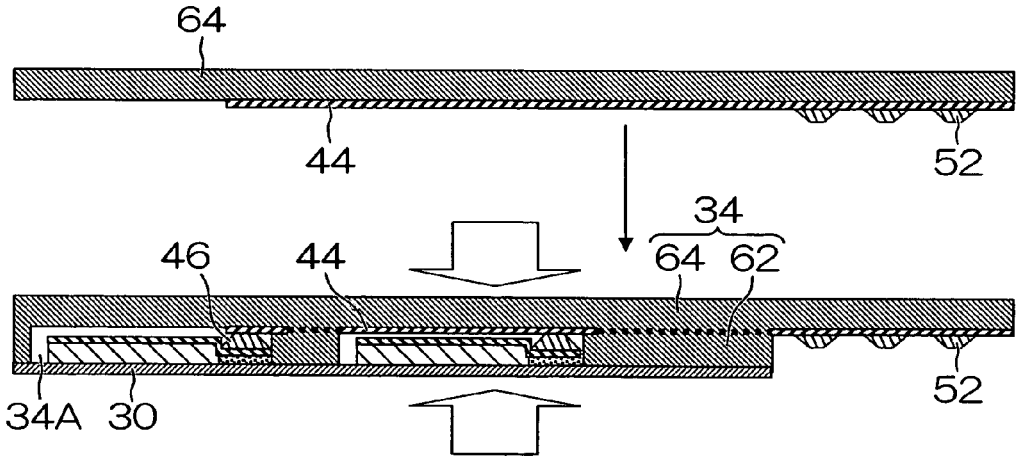

It is possible that position alignment is performed according to the piezoelectric elements 32, the first intermediate sheet 62 is stacked on the diaphragm 30, and the adhesion is performed simultaneously with the heating and pressurization process in the subsequent step show in FIG. 3E.

Step 5: Step of Stacking of Second Intermediate Sheet and Forming an Electrical Connection Next, as shown in FIG. 3E, the resin wiring sheet (second intermediate sheet) 64 on which the electric wiring 44 and the bumps for IC connection 52 are formed beforehand is stacked on the first intermediate sheet 62. Then, the resin wiring sheet (second intermediate sheet) 64 is heated and pressurized, so as to electrically connect the bumps 46 and the electric wiring 44, to form ceiling surfaces of the openings 62A of the first intermediate sheet 62, and to seal the piezoelectric elements 32 in the recess sections 34A. A predetermined space required in a displacement of each piezoelectric element 32 is secured by a recess section 34A so that the displacement of the piezoelectric element 32 is not restrained. In the present embodiment, the above Steps 4 and 5 correspond to the step of stacking of the intermediate plate.

It should be noted that, as the method of forming the electric wiring 44 on the resin wiring sheet 64, there is a method of etching a copper foil (the same method as a general formation method for a printed board wiring), an electroplating method, and a method based on printing of a conductive paste.

In the case in which the wiring layer is situated on only one side of the resin wiring sheet 64, as shown in FIG. 3E, the characteristics are obtained in which the wiring can be completed within a single plane surface. The wiring layer may be formed as the one side layer as shown in the present embodiment; however a vertical wiring technique, such as technique based on a through hole, may be used, if necessary, for forming a multi-layered resin wiring sheets. In such a case, the drive IC can be mounted on the opposite surface.

Step 6: Step of Mounting (Electrically Connecting) IC

Figure 3F:
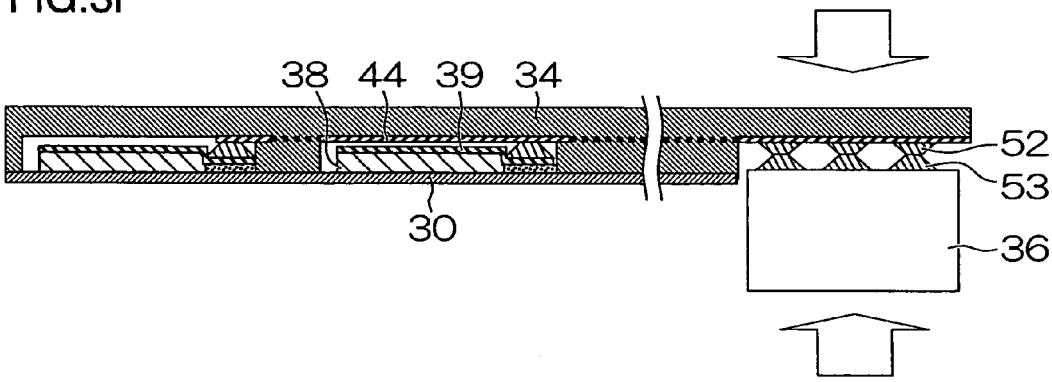

Subsequently, as shown in FIG. 3F, the drive IC 36 is disposed in accordance with the positions of the bumps 52 for IC connection, and then the heating and pressurization process is performed to create an electrical connection (bonding) between the drive IC 36 and the electric wiring 44. After the connection is formed, the connection section (around the bumps 52 and 53) is filled with the insulating resin (i.e., underfill material) 54 (see FIG. 3G). In the present embodiment, the above Step 6 corresponds to the IC connection step.

Step 7: Step of Forming a Hole for the Ink Flow Path

Figure 3G:
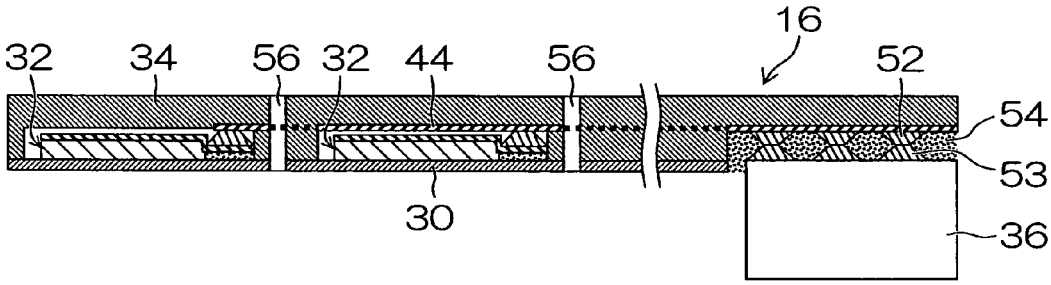

Next, as shown in FIG. 3G, holes for the ink flow paths 56 penetrating through the intermediate plate 34 and the diaphragm 30 are formed. In this manner, "actuator function unit" capable of driving a piezoelectric element 32 in this state described above can be created. It should be noted that the step of forming the holes for the ink flow paths 56 is not limited to the mode performed in this stage (i.e., in step 7), and thus the holes may be formed in the intermediate sheets (62, 64) before the intermediate sheets are stacked, which is described in the above Steps 4 and 5.

Step 8: Drive Evaluation Step

Figure 3H:
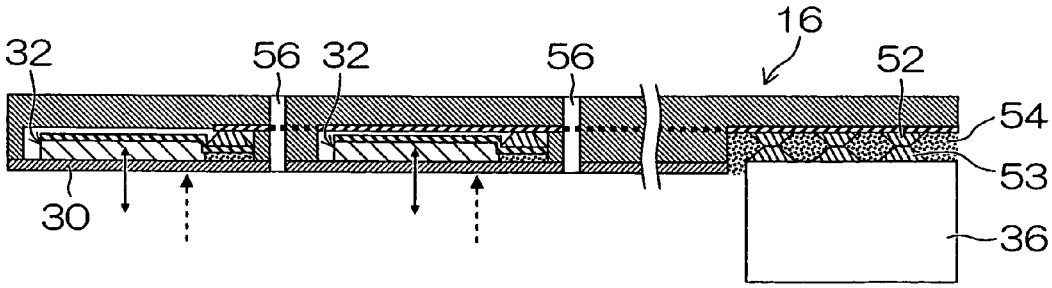
Figure 3I:
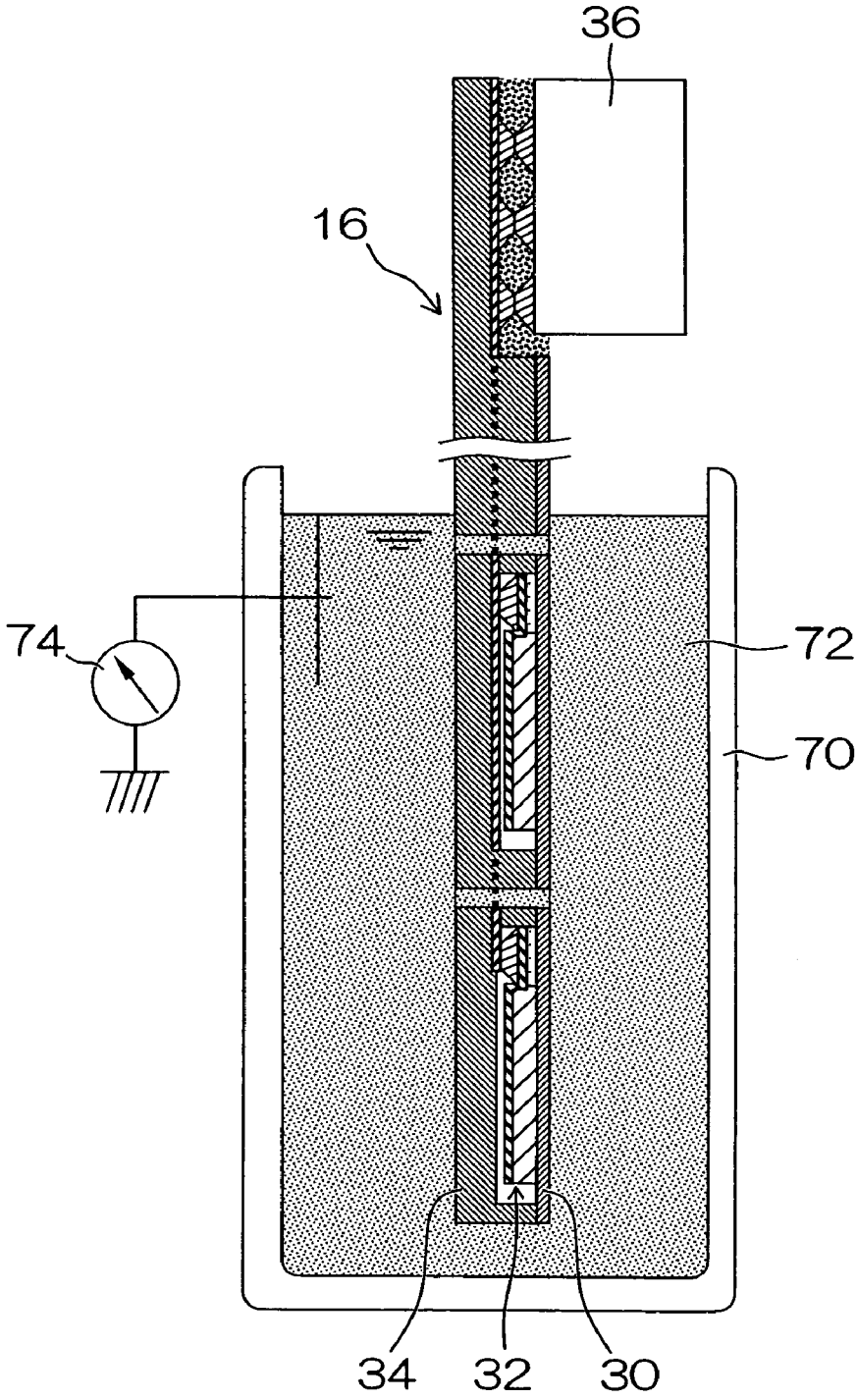

At the stage where the actuator function unit 16 has completed through the above steps, drive evaluation is carried out for each unit. Specifically, as shown in FIG. 3H, various examinations and evaluations such as driving the drive IC 36, driving the piezoelectric elements 32, and measuring a displacement of the diaphragm 30 are carried out. The number of signal lines for controlling the drive of the drive IC 36 is less than the number of the elements. When supposedly the piezoelectric elements on the diaphragm are examined individually, the number of terminals equivalent to the number of the elements are required. However, in the IC drive control signals in such a unit of the present embodiment, only approximately ten through twenty control signal lines are required while the number of elements are 200 through 500. A specific embodiment of the drive evaluation is described hereinafter. In the present embodiment, the above Step 8 corresponds to the drive evaluation step.

Step 9: Ink-sealing Evaluation Step

Next, an ink-sealing function (which represents the ink is not in contact with the wiring or piezoelectric elements) is examined and evaluated in the above state of the unit. As shown in FIG. 31, the actuator function unit 16 is immersed in conductive liquid 72 which is held inside an appropriate container 70, voltage is applied to each piezoelectric element 32 through the drive IC 36, and the potential of the liquid 72 or current which flows from the liquid 72 to GND is measured. FIG. 31 shows an embodiment in which the current is measured by an ammeter 74. If the ink-sealing of the actuator function unit 16 is perfect, no current flows. However, if there is some area where the ink-sealing is insufficient, the current flows therethrough. In this way, the sealing property can be determined.

It should be noted that, regarding the section of the actuator function unit 16 which contacts at least with the ink, this section is brought into contact with the liquid 72 to examine the ink-sealing function. In the present embodiment, the above Step 9 corresponds to the sealing evaluation step.

Figure 3J:
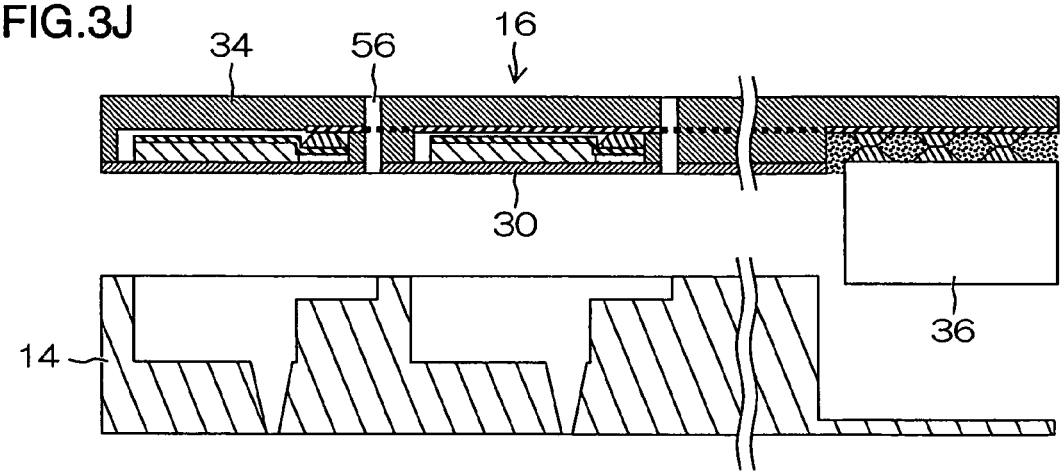

Step 10: Step of Bonding the Actuator Function Unit to the Pressure Chamber Forming Member As shown in FIG. 3J, the pressure chamber forming member 14, which is created separately, is bonded to the actuator function unit 16 with which the evaluation steps of the above Steps 9 and 10 are completed.

Step 11: Step of Bonding the Nozzle Plate

Figure 3K:
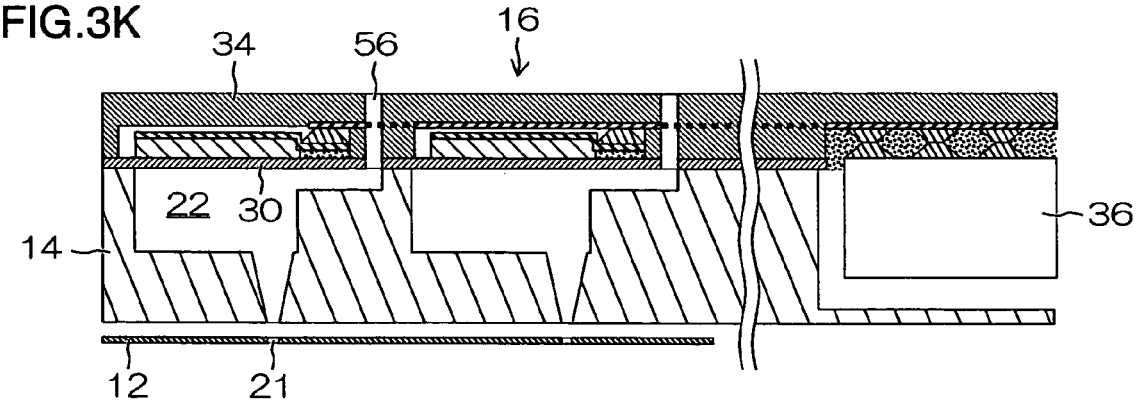

Further, as shown in FIG. 3K, the nozzle plate 12 is bonded to an ejection surface side of the pressure chamber forming member 14.

Step 12: Step of Bonding the Ink Pool Forming Member

Figure 3L:
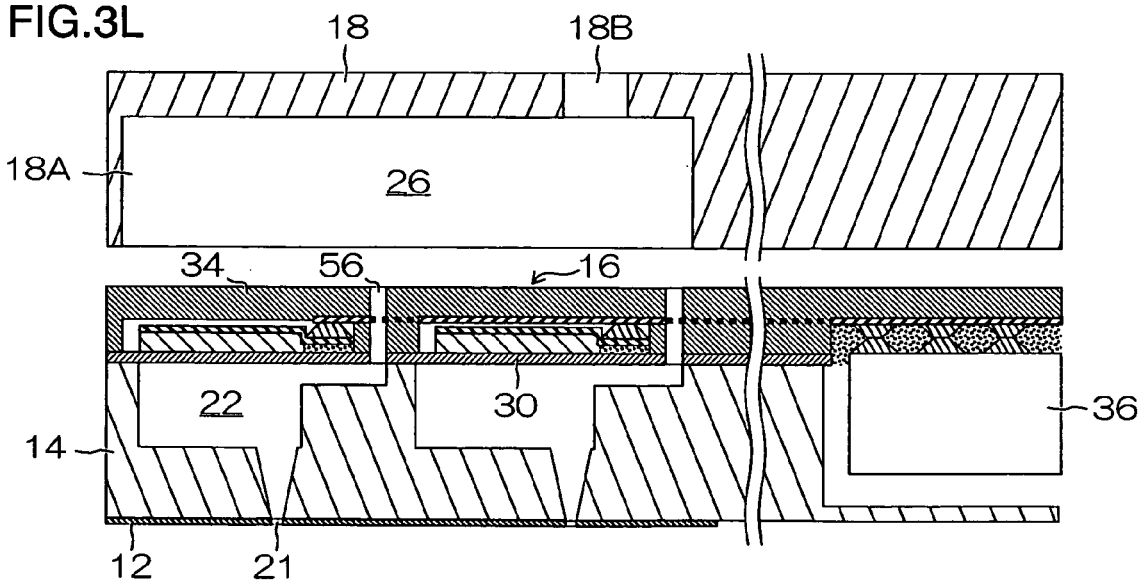

Moreover, as shown in FIG. 3L, an ink pool forming member 18 is bonded to the upper side of the actuator function unit 16 (which is the opposite side of the actuator function unit 16 from the pressure chamber 22) to complete the inkjet head 10 described with reference to FIG. 1. It should be noted that the order of the bonding steps in FIGS. 3J through FIG. 3L is not particularly limited. In the present embodiment, the above Steps 10 through 12 correspond to the step of bonding the flow path forming member.

Here, an embodiment of the detail of the drive evaluation in the above Step 8 is explained.

In the drive evaluation step, for example, a displacement of the diaphragm 30 is measured. Regarding a method of measuring a displacement of the diaphragm, there is, for example, a laser Doppler method as a technique for measuring a small displacement of several μm or less.

In the measurement using a laser, a laser is radiated onto an object and the obtained reflection is measured. However, since the laser is a light beam, scanning can be performed in one-dimensional direction or two-dimensional directions by means of a mirror (such as a galvano mirror (galvanometer mirror) or a polygon mirror).

Therefore, in the measurement of a displacement of the piezoelectric element of the actuator function unit 16 of the present embodiment as well, a displacement or velocity of the elements aligned in a planar state can be measured by scanning at high speeds by means of the scanning method using the mirror.

Furthermore, by performing this scanning method in a small region, a distribution of displacements of the diaphragm corresponding to the respective elements can be measured, the displacements within the element can be observed, and the displacement state of the diaphragm can be measured more precisely.

By measuring a displacement of the diaphragm as described above, the following matters can be understood. Specifically, when the diaphragm does not operate, it is determined that the piezoelectric element 32, the drive IC 36, or the wiring is defective.

Moreover, the drive capability of the diaphragm with respect to each element (sum of the efficiency of the piezoelectric element and of the diaphragm and irregularity of the drive capability for the IC in each element) and the frequency characteristics of each element can be checked (in order to understand the frequency characteristics, the sweep of the drive frequency may be performed and a displacement of the diaphragm may be measured).

Various modes are considered in the way of using a result of the measurement, and the results of the measurement are used in, for example, the correction on a piezoelectric element basis (i.e., the correction for each piezoelectric element) or the correction on a unit basis.

An embodiment of the correction of each piezoelectric element unit is described hereinafter.

1 When the drive IC can control a drive amount of each piezoelectric element, a drive amount (gain) for the IC is set in accordance with a result of the measurement.

Figure 4:
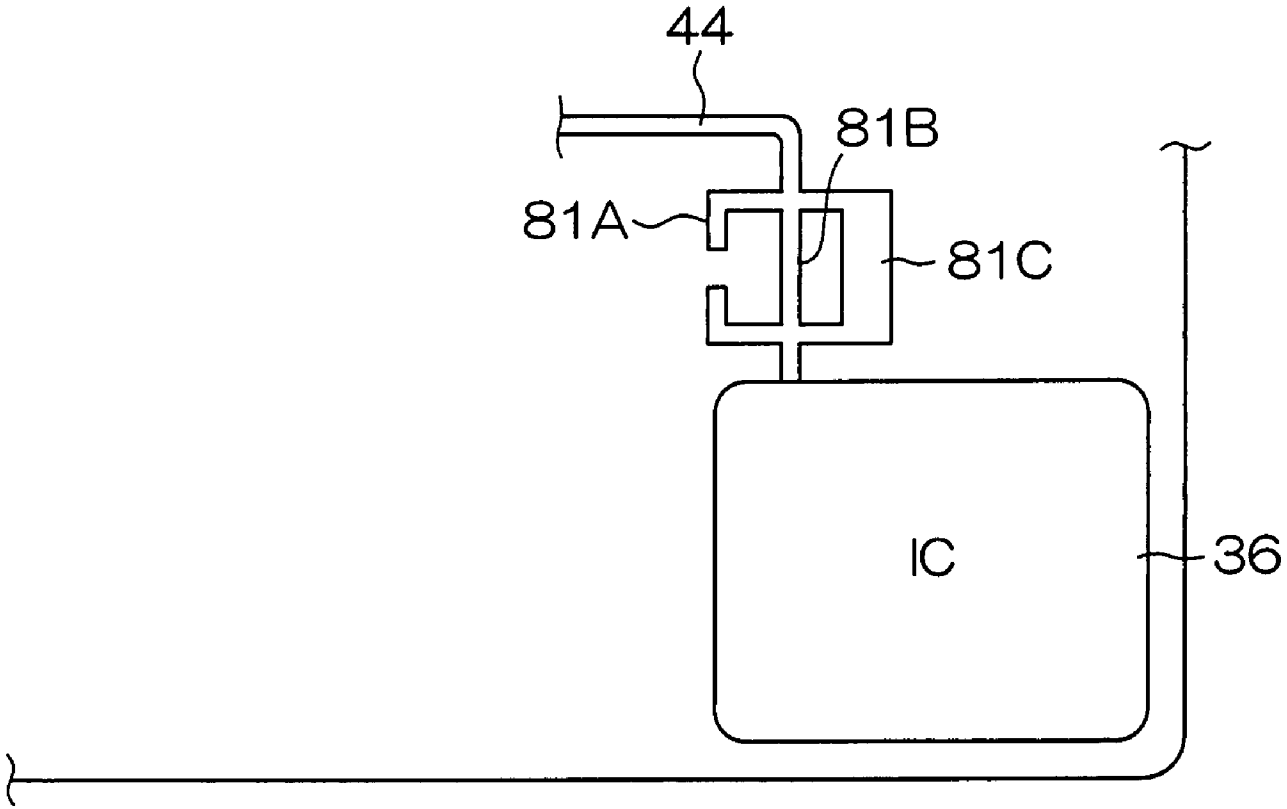
FIG. 4 is a figure showing an embodiment of a method of adjusting a resistance value of a resistance element provided in a wiring section.

2 The drive amount is adjusted for each element by selecting a resistance element provided in the wiring section. An embodiment is shown in FIG. 4. FIG. 4 is a plan view which schematically illustrates a situation in which the periphery of the drive IC connection section of the actuator function unit 16 is viewed from the drive IC side.

As shown in FIG. 4, a plurality of resistance sections 81A, 81B, and 81C, which are wired in a part of the electric wiring 44 (a part of the exposed section) connected to the drive IC 36, are provided, and the wiring is cut (laser trimming) so that only the connection of necessary resistance sections is established. The resistance values can be adjusted by such a method. FIG. 4 shows an embodiment in which the wiring of the resistance section 81A is cut.

By performing such a wiring resistance correction step described above during the manufacturing process, correction of wiring resistance can be achieved for each element (on an element basis).

3 The diameter of a nozzle corresponding to each element is adjusted in accordance with the characteristics of each element. For example, the nozzle hole corresponding to the element having small driving force is enlarged. At the time of forming the nozzle hole by means of a laser (at the time of forming a hole in the nozzle plate), the diameter of each nozzle is changed on a nozzle basis in accordance with the characteristics of each element. For the nozzle corresponding to the element for which the drive displacement of the diaphragm is small, the nozzle diameter is enlarged to uniform the sizes of droplets. Further, the basic formation of a hole may be performed by means of an etching method or a mold, and the hole diameter may be enlarged using a laser or the like only when the adjustment is performed in accordance with the characteristics of the elements.

4 As with the item 3 described above, the diameter of an ink supply hole (supply aperture) is adjusted for each element. For example, the supply hole of the element having the small driving force is enlarged. As with the above-described adjustment of the nozzle diameter, the diameter of the ink supply hole can be adjusted by means of the laser treatment.

The correction steps described in the above items 3 and 4 correspond to the "hole diameter correction step".

Further, as an embodiment of performing correction for each unit (on a unit basis), there is a mode in which the average value of the characteristics of all units is calculated, and then the unit in which, with respect to the average value, a displacement of the diaphragm is large (evaluated based on the average value) is combined with a lower unit having a small-sized pressure chamber (pressure chamber forming member). In this manner, even when the irregularities in the displacement of the diaphragm or in the size of the pressure chambers are significant at the time of the manufacture, such irregularities can be combined well (units whose characteristics match with each other can be combined) to reduce the total irregularity.

According to the method of manufacturing a liquid ejection head according to an embodiment of the present invention, the mounting and connection of the diaphragm 30, piezoelectric elements 32, electric wiring 44, and drive IC 36 are carried out before the integration of the piezoelectric elements 32 and the flow path forming members such as pressure chamber 22 is performed, and then the drive examination and evaluation is carried out for each single actuator function unit 16 (on an actuator function unit 16). Therefore, the examination and evaluation of the operation of each piezoelectric element 32 and of the displacement of the diaphragm 30 can be performed without the filling with liquid (ink) and the ejection of liquid (ink). Since each piezoelectric element 32 and the diaphragm 30 can be actually driven and the displacement itself of the diaphragm 30 can be measured, only the characteristics of each piezoelectric element 32 and diaphragm 30 can be extracted and measured.

Specifically, when the evaluation needs the filling with the ink and the ejection of the ink (for example, in the case of Japanese Patent Application Publication No. 7-186386), it is difficult to analyze a result of the evaluation because a plurality of factors are involved. However, in the present embodiment, only the characteristics of each piezoelectric element 32 and the diaphragm 30, which are similar to the actual ejection characteristics, can be extracted and measured, and hence the plurality of factors are not involved. Therefore, analyzing the evaluation result can be carried out easily and a feedback into steps of producing each member can be provided easily.

Regarding the target of measurement (examination) and evaluation, in Japanese Patent Application Publication No. 2003-326723, the electrostatic capacity of the piezoelectric body is electrically measured to evaluate the characteristics of the piezoelectric body. However, the characteristics of electrical-mechanical conversion of the piezoelectric body are not reflected in the electrostatic capacity. Thus, as the characteristics of the inkjet head which are similar to the actual ejection characteristics, the displacement of the diaphragm is more likely the parameter than the electrostatic capacity.

Moreover, according to the present embodiment, a movement of the diaphragm 30 can be directly observed in the state of the actuator function unit 16, and hence general materials can be used without requiring special materials such as transparent materials. Therefore, material costs and production costs can be kept low, and materials which have excellent electrical characteristics can be selected. It should be noted that the present embodiment describes an embodiment in which the diaphragm 30 is exposed in the state of the actuator function unit 16; but in an implementation of the present invention, the present embodiment is not necessarily limited to the embodiment in which the diaphragm 30 is exposed in the state of the actuator function unit 16, and hence any circumstances are possible as long as the movement of the diaphragm 30 can be observed easily.

Moreover, according to the present embodiment, even if characteristic defects, and the like, are supposedly observed at the stage of examining and evaluating each actuator function unit 16, the entire head do not become defective. It is only necessary to discard the defective actuator function units only, and thus the heads can be produced without reducing the yield of production of the entire heads.

The above fact is effective particularly when the following types of heads are adopted. In other words, the above fact is particularly effective when a head is configured by forming the pressure chambers as an integrated configuration or forming a combination of the pressure chambers and nozzles as an integrated configuration corresponding to the width of the head, and arranging a plurality of short (1 inch through 2 inches) "actuator function units" in the pressure chamber sections.

According to the present embodiment, the electrical and mechanical characteristics of the piezoelectric element 32 and the diaphragm 30 can be evaluated for each actuator function unit 16 before bonding the actuator function unit 16 to the pressure chamber forming member 14. Therefore, the pressure chamber forming member 14 which is selected in accordance with the characteristics of the actuator function unit 16 and matches the characteristics of the actuator function unit 16 can be bonded to the actuator function unit 16, or alternatively a corrective treatment is applied to the pressure chamber forming member 14 so as to match with the characteristics; thereby, the characteristics of the entire head can be made uniform.

In addition, according to the present embodiment, when the actuator function unit 16 is completed, the electrical connection step is finished, and thus it is not necessary to subject the pressure chamber forming member 14 or the nozzle plate 12 to high temperature and high pressure in the subsequent steps. Therefore, the demands (restrictions in the design) for the heat resistance characteristics and the temperature characteristics (such as the coefficient of thermal expansion) of the pressure chamber forming member 14, and the like, can be alleviated. Further, additional functions (e.g., a sensor and wiring) can be easily incorporated into the pressure chamber forming member 14.

It should be noted that the above-described embodiment illustrates the structure in which the ink pool 26 is formed across the diaphragm 30 from the pressure chamber 22, but the relationship of the arrangement between the pressure chamber and the ink pool is not limited to the embodiment described in the present embodiment. Another mode is possible in which the ink pool and the pressure chamber are disposed on the same side with respect to the diaphragm. In this case, the flow path forming member which forms the ink pool and the flow path forming member which forms the pressure chamber may be constituted with different members or may be constituted with the same member.

Embodiment of Application to the Inkjet Recording Apparatus

Figure 5:
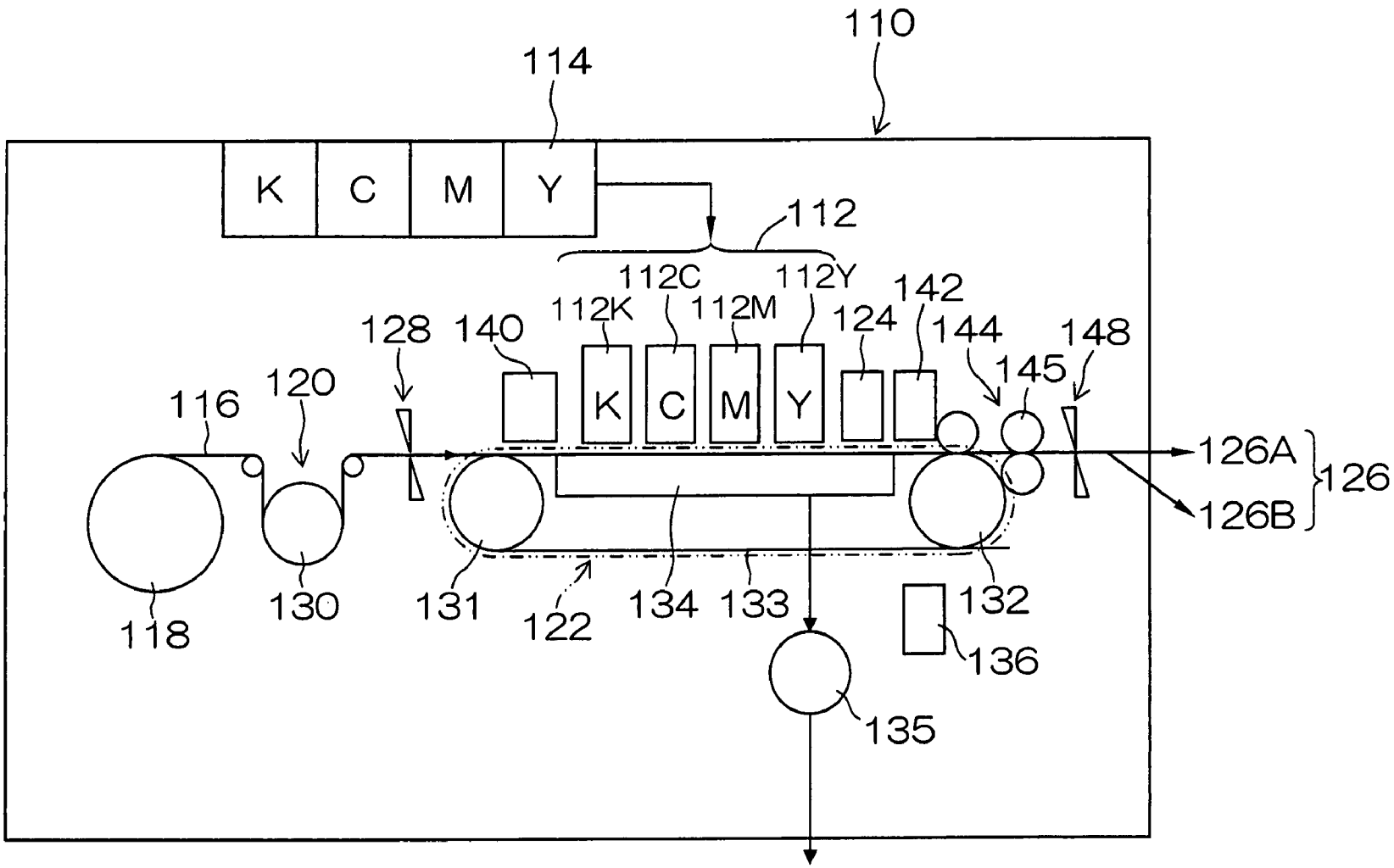
FIG. 5 is a general schematic drawing of the inkjet recording apparatus according to an embodiment of the present invention.

FIG. 5 is a general schematic drawing of the inkjet recording apparatus which shows an embodiment of the image forming apparatus according to the present invention. As shown in FIG. 5, this inkjet recording apparatus 110 comprises a print unit 112 having a plurality of inkjet heads (referred to as "heads" hereinafter) 112K, 112C, 112M, and 112Y provided for inks of black (K), cyan (C), magenta (M) and yellow (Y) respectively, an ink storing and loading unit 114 which stores the inks supplied to the heads 112K, 112C, 112M and 112Y, a paper supply unit 118 which supplies a recording paper 116 as a recording medium, a decurling unit 120 which removes a curl formed on the recording paper 116, a belt conveying unit 122 which is disposed facing the nozzle surface (ink ejection surface) of the print unit 112 and conveys the recording paper 116 while keeping the flatness of the recording paper 116, a print determination unit 124 which reads a result of printing performed by the print unit 112, and a paper output unit 126 which outputs, to the outside, a recording paper (printed matter) on which recording is completed.

As each of the heads 112K, 112C, 112M and 112Y of the print unit 112, the inkjet head 10 described with reference to FIG. 1 through FIG. 4 is used.

The ink storing and loading unit 114 shown in FIG. 5 has ink tanks for storing the inks of K, C, M and Y to be supplied to the heads 112K, 112C, 112M, and 112Y, and the tanks are connected to the heads 112K, 112C, 112M, and 112Y by means of prescribed channels. The ink storing and loading unit 114 has a warning device (for example, a display device or an alarm sound generator) for warning when the remaining amount of any ink is low, and has a mechanism for preventing loading errors among the colors.

In FIG. 5, a magazine for rolled paper (continuous paper) is shown as an embodiment of the paper supply unit 118; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording medium (media) can be used, it is preferable that an information recording medium such as a bar code and a wireless tag containing information about the type of media is attached to the magazine, and by reading the information contained in the information recording medium with a predetermined reading device, the type of recording medium to be used (type of media) is automatically determined, and ink-droplet ejection is controlled so that the ink-droplets are ejected in an appropriate manner in accordance with the type of medium.

The recording paper 116 delivered from the paper supply unit 118 retains curl due to having been loaded in the magazine. In order to remove the curl, heat is applied to the recording paper 116 in the decurling unit 120 by a heating drum 130 in the direction opposite from the curl direction in the magazine. The heating temperature at this time is preferably controlled so that the recording paper 116 has a curl in which the surface on which the print is to be made is slightly round outward.

In the case of the configuration in which roll paper is used, a cutter (first cutter) 128 is provided as shown in FIG. 5, and the continuous paper is cut into a desired size by the cutter 128. When cut papers are used, the cutter 128 is not required.

The decurled and cut recording paper 116 is delivered to the belt conveyance unit 122. The suction belt conveyance unit 122 has a configuration in which an endless belt 133 is set around rollers 131 and 132 so that the portion of the endless belt 133 facing at least the nozzle face of the printing unit 112 and the sensor face of the print determination unit 124 forms a horizontal plane (flat plane).

The belt 133 has a width that is greater than the width of the recording paper 116, and a plurality of suction apertures (not shown) are formed on the belt surface. A suction chamber 134 is disposed in a position facing the sensor surface of the print determination unit 124 and the nozzle surface of the printing unit 112 on the interior side of the belt 133, which is set around the rollers 131 and 132, as shown in FIG. 5. The suction chamber 134 provides suction with a fan 135 to generate a negative pressure, and the recording paper 116 is held on the belt 133 by suction. In place of the suction system, the electrostatic attraction system can be employed.

The belt 133 is driven in the clockwise direction in FIG. 5 by the motive force of a motor (not shown) being transmitted to at least one of the rollers 131 and 132, which the belt 133 is set around, and the recording paper 116 held on the belt 133 is conveyed from left to right in FIG. 5.

Since ink adheres to the belt 133 when a marginless print job or the like is performed, a belt-cleaning unit 136 is disposed in a predetermined position (a suitable position outside the printing area) on the exterior side of the belt 133. Although the details of the configuration of the belt-cleaning unit 136 are not shown, embodiments thereof include a configuration in which the belt 133 is nipped with cleaning rollers such as a brush roller and a water absorbent roller, an air blow configuration in which clean air is blown onto the belt 133, or a combination of these. In the case of the configuration in which the belt 133 is nipped with the cleaning rollers, it is preferable to make the line velocity of the cleaning rollers different from that of the belt 133 to improve the cleaning effect.

The inkjet recording apparatus 110 can comprise a roller nip conveyance mechanism, instead of the belt conveyance unit 122. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 140 is disposed on the upstream side of the printing unit 112 in the conveyance pathway formed by the belt conveyance unit 122. The heating fan 140 blows heated air onto the recording paper 116 to heat the recording paper 116 immediately before printing so that the ink deposited on the recording paper 116 dries more easily.

The heads 112K, 112C, 112M and 112Y of the printing unit 112 are full line heads having a length corresponding to the maximum width of the recording paper 116 used with the inkjet recording apparatus 110, and comprising a plurality of nozzles for ejecting ink arranged on a nozzle face through a length exceeding at least one edge of the maximum-size recording medium (namely, the full width of the printable range).

The print heads 112K, 112C, 112M and 112Y are arranged in color order (black (K), cyan (C), magenta (M), yellow (Y)) from the upstream side in the feed direction of the recording paper 116, and these respective heads 112K, 112C, 112M and 112Y are fixed extending in a direction substantially perpendicular to the conveyance direction of the recording paper 116.

A color image can be formed on the recording paper 116 by ejecting inks of different colors from the heads 112K, 112C, 112M and 112Y, respectively, onto the recording paper 116 while the recording paper 116 is conveyed by the belt conveyance unit 122.

By adopting a configuration in which the full line heads 112K, 112C, 112M and 112Y having nozzle rows covering the full paper width are provided for the respective colors in this way, it is possible to record an image on the full surface of the recording paper 116 by performing just one operation (one sub-scanning operation) of relatively moving the recording paper 116 and the printing unit 112 in the paper conveyance direction (the sub-scanning direction), in other words, by means of a single sub-scanning action. Higher-speed printing is thereby made possible and productivity can be improved in comparison with a shuttle type head configuration in which a recording head reciprocates in the main scanning direction.

Although the configuration with the KCMY four standard colors is described in the present embodiment, combinations of the ink colors and the number of colors are not limited to those. Light inks, dark inks or special color inks can be added as required. For example, a configuration is possible in which inkjet heads for ejecting light-colored inks such as light cyan and light magenta are added. Furthermore, there are no particular restrictions of the sequence in which the heads of respective colors are arranged.

The print determination unit 124 shown in FIG. 5 has an image sensor (line sensor or area sensor) for rendering an image of a result of a droplet ejected from the print unit 112. The print determination unit 124 functions as a device which measures the interdependence between dots and a dot displacement amount on the basis of the droplet image read by the image sensor, and also functions as a device which checks ejection defects such as jamming in the nozzles or displacement of the position on which the droplet is deposited. A test pattern or an actual image on which characters are printed by each color of heads 112K, 112C, 112M and 112Y is read out by the print determination unit 124, and ejection determination is performed on each of the heads. The ejection determination comprises the steps of determining the presence of ejection, measuring the size of a dot, and measuring the position of a deposited dot.

A post-drying unit 142 is disposed following the print determination unit 124. The post-drying unit 142 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 144 is disposed following the post-drying unit 142. The heating/pressurizing unit 144 is a device to control the glossiness of the image surface, and the image surface is pressed with a pressure roller 145 having a predetermined uneven surface shape while the image surface is heated, and the uneven shape is transferred to the image surface.

The printed matter generated in this manner is outputted from the paper output unit 126. The target print (i.e., the result of printing the target image) and the test print are preferably outputted separately. In the inkjet recording apparatus 110, a sorting device (not shown) is provided for switching the outputting pathways in order to sort the printed matter with the target print and the printed matter with the test print, and to send them to paper output units 126A and 126B, respectively. When the target print and the test print are simultaneously formed in parallel on the same large sheet of paper, the test print portion is cut and separated by a cutter (second cutter) 148. Although not shown in FIG. 5, the paper output unit 126A for the target prints is provided with a sorter for collecting prints according to print orders.

Structure of the Head

Next, the structure of a head is described. The heads 112K, 112C, 112M and 112Y of the respective ink colors have the same structure, and a reference numeral 150 is hereinafter designated to any of the heads.

Figure 6:
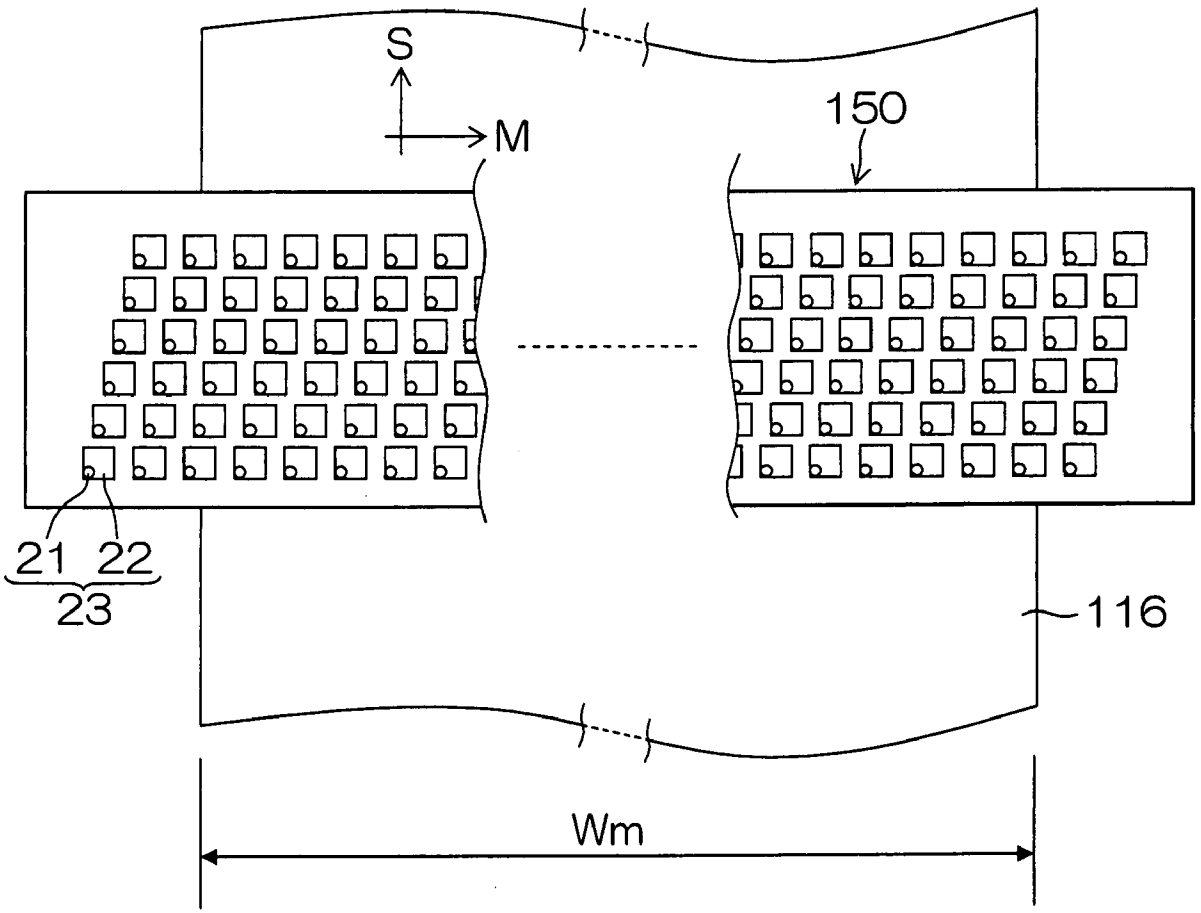
FIG. 6 is a plan perspective view showing a constructional embodiment of the head.
Figure 7:
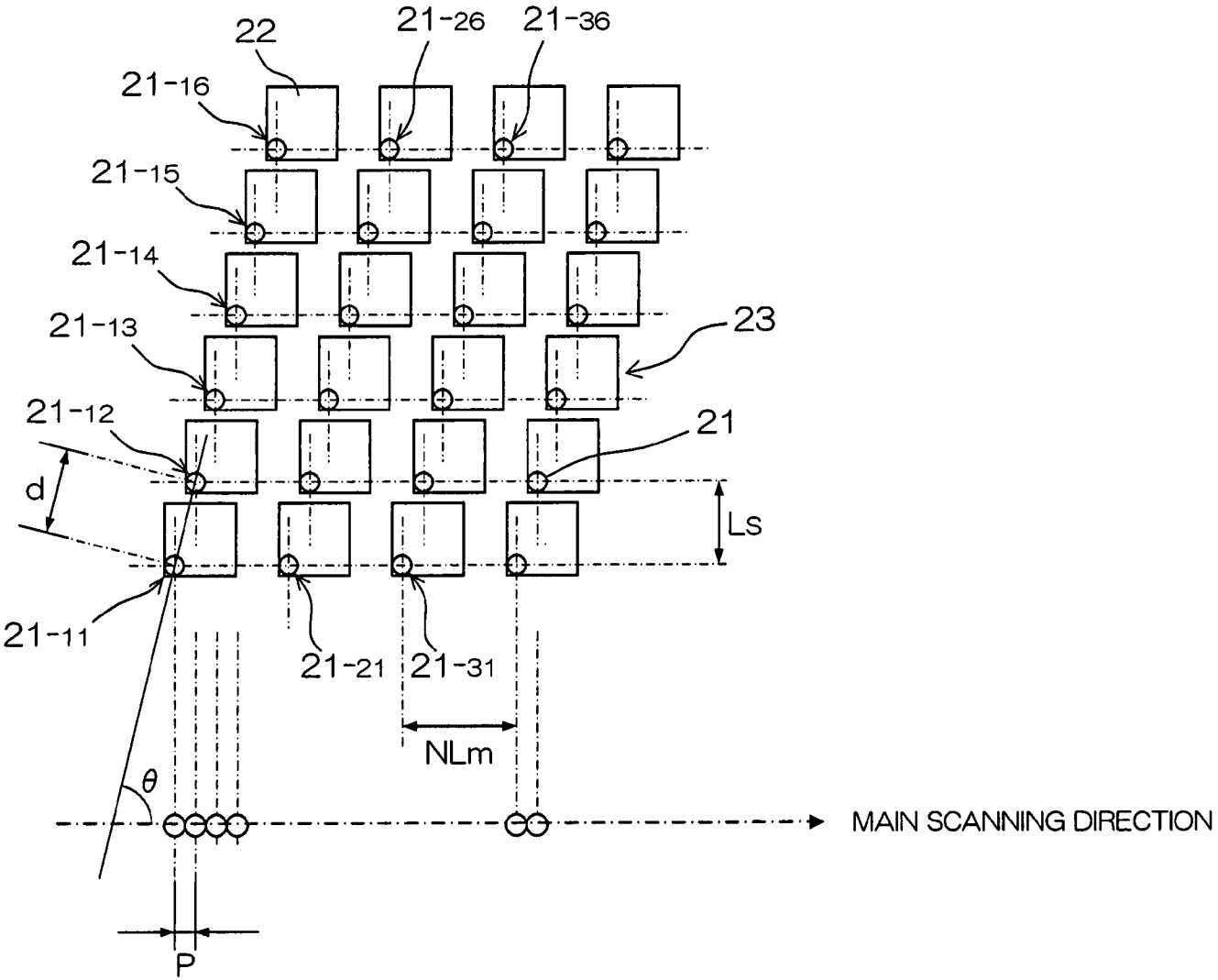
FIG. 7 is an enlarged view showing a nozzle arrangement of the head shown in FIG. 6.

FIG. 6 is a plan perspective view showing a constructional embodiment of a head 150, and FIG. 7 is an enlarged view of a principle component of the head 150.

As shown in FIG. 6, the head 150 has a structure in which a plurality of ink chamber units (a liquid droplet ejection element which is a recording element corresponding to one nozzle) 23, each of which comprises the nozzle 21 as the ink ejection port and the pressure chamber 22 corresponding to the nozzle 21, are arranged two-dimensionally in a matrix. Accordingly, a nozzle row having the length corresponding to the entire width Wm of the recording medium (recording paper 116) is configured in a direction (direction of the arrow M: main scanning direction) which is approximately perpendicular to the feed direction (direction of the arrow S: sub-scanning direction) of the recording medium (recording paper 116).

In the matrix arrangement shown in FIG. 6, for the convenience of explanation, the lateral direction (main scanning direction) in FIG. 6 is illustrated as a row direction and the vertical direction (sub-scanning direction) in FIG. 6 is illustrated as a column direction.

The planar shape of the pressure chamber 22 provided for each nozzle 21 is in the form of a rough square, and an outlet extended to the nozzle 21 (the communication port led to a nozzle flow path 24 in FIG. 1) is provided on a section at a corner in the vicinity of the top of the pressure chamber 22. It should be noted that although an inlet for the supplied ink (the communication port led to the individual supply path 28 in FIG. 1) is not shown in FIG. 6, it is provided on other corner in the vicinity of the top of the pressure chamber 22, preferably a corner which is located diametrically opposite to the nozzle 21.

The planar shape of the pressure chamber 22 is not limited to that described in the present embodiment, thus various shapes such as a square (rhombus, rectangle, or the like), pentagon, hexagon, other polygonal shapes, circle, and oval shape are possible.

As shown in FIG. 7, the head 150 of the present embodiment has a structure in which the plurality of ink chamber units 23 are arranged in a matrix (in a diagonal reticular patter) according to a fixed arrangement pattern along a row direction and a diagonal column direction (approximately vertical direction in FIG. 7) which is not perpendicular to the row direction, whereby a head having a highly dense nozzle arrangement can be realized.

More specifically, by adopting a structure in which a plurality of ink chamber units 23 are arranged at a uniform pitch d in line with a direction forming an angle of θ with respect to the main scanning direction (row direction), the pitch P of the nozzles projected so as to align in the main scanning direction is d×cos θ, and hence the nozzles 21 can be regarded to be equivalent to those arranged linearly at a fixed pitch P along the main scanning direction. Such configuration results in a nozzle structure in which the nozzle row projected in the main scanning direction has a high nozzle density of up to 2,400 nozzles per inch.

To describe the two dimensional arrangement shown in FIG. 7 from a different perspective, when a nozzle space NLm within a row of nozzles 21 arranged in the main scanning direction (row direction) is constant (each of nozzle space Nlm in each row in the main scanning direction is the same Nlm), nozzles 21-*ij* in each row are in the form of staggered arrangement, wherein the distance between the nozzle positions is different in the main scanning direction. Specifically, if the number of nozzle rows (the number of nozzles in the sub-scanning direction) in the main scanning direction of the two-dimensional nozzle arrangement on the nozzle surface (ejection surface) is n (n=6 in FIG. 7), and the practical pitch between the main scanning direction nozzles which deposit dots aligned along the main scanning direction on the recording medium is P, the relationship of NLm=n×P is satisfied. Moreover, the distance Ls between the rows (distance between the nozzles in the sub-scanning direction) in the sub-scanning direction (row direction in the nozzle arrangement) is constant.

In a full-line head comprising rows of nozzles that have a length corresponding to the entire width of the image recordable width, the "main scanning" is defined as printing one line (a line formed of a row of dots, or a line formed of a plurality of rows of dots) in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 21 arranged in a matrix such as that shown in FIG. 2 are driven, the main scanning according to the above-described (3) is preferred. More specifically, the nozzles 21-11, 21-12, 21-13, 21-14, 21-15 and 21-16 are treated as a block (additionally; the nozzles 21-21, . . . , 21-26 are treated as another block; the nozzles 21-31, . . . , 21-36 are treated as another block; . . . ); and one line is printed in the width direction of the recording medium by sequentially driving the nozzles 21-11, 21-12, . . . , 21-16 in accordance with the conveyance velocity of the recording medium 16.

On the other hand, "sub-scanning" is defined as to repeatedly perform printing of one line (a line formed of a row of dots, or a line formed of a plurality of rows of dots) formed by the main scanning, while moving the full-line head and the recording medium relatively to each other.

The direction which is indicated with one line recorded in the above-described main scanning (or the lengthwise direction in the strip-shaped region) is referred to as "main scanning direction", and the direction for performing the above-mentioned sub scanning is referred to as "sub-scanning direction". Specifically, in the present embodiment the direction of conveying the recording medium is the sub-scanning direction, and the direction perpendicular to the sub-scanning direction is the main scanning direction.

In an implementation of the present invention, the arrangement of the nozzles is not limited to the embodiment shown in FIG. 7. Moreover, the present embodiment shows a configuration in which six nozzle rows in which the nozzles 21 are aligned in the row direction are arranged in the column direction, but in the implementation of the present invention the number of nozzle rows (number of rows) n is not particularly limited. However, it is assumed that the n is an integer of 3 or above (three rows or more) so that a highly dense arrangement is achieved.

Figure 8:
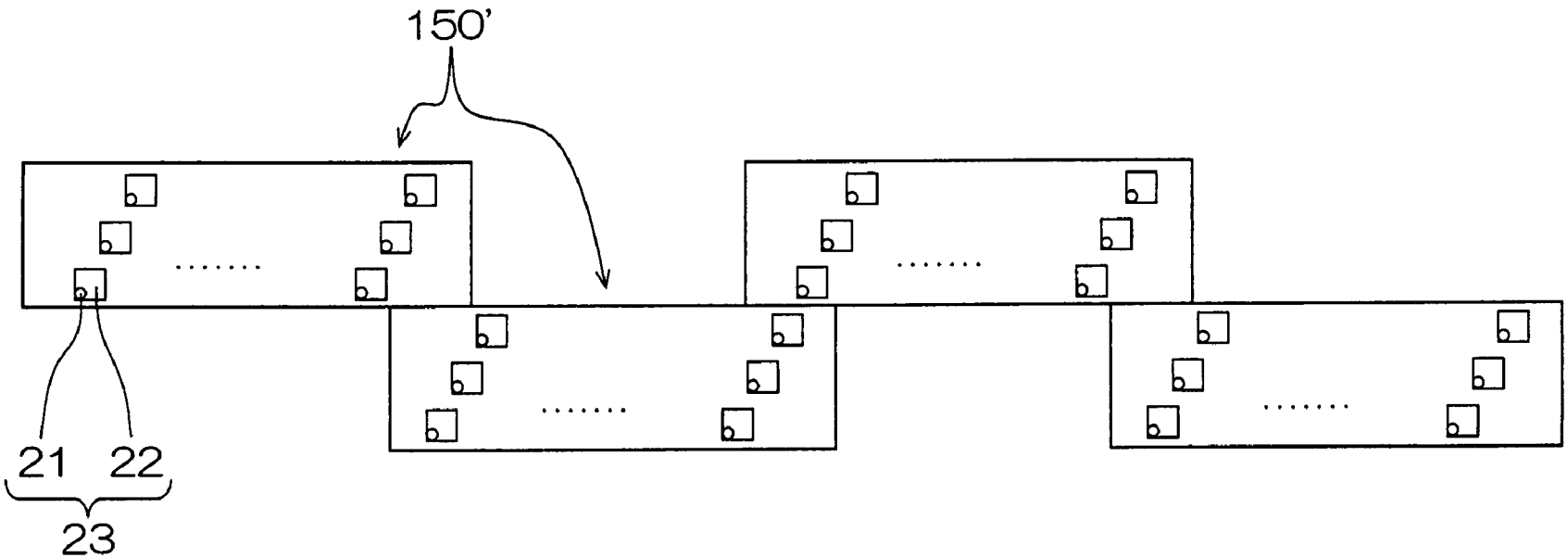
FIG. 8 is a plane view showing another constructional embodiment of a full-line head.

It should be noted that an embodiment of configuring the full-line type head is not limited to an embodiment in which a nozzle row is configured, in one head, throughout the length of the entire width Wm of the recording medium in the direction which is approximately perpendicular to the direction of feeding the recording medium, as shown in FIG. 6. For example, instead of the configuration shown in FIG. 6, a line head, which has a nozzle row having the length corresponding to the entire width of the recording medium, may be configured by arranging, in a zigzag fashion, short head modules 150' in which the plurality of nozzles 12 are arranged two-dimensionally, and connecting these head modules 150' as shown in FIG. 8.

The above embodiment has described the inkjet recording apparatus which uses the full-line type head, but the scope of application of the present invention is not limited to this embodiment. The present invention can be applied to a case in which scanning is performed a number of times by, for example, using a head having length shorter than the width of the recording medium (recording paper 116 or other print medium), as in a shuttle scanning system.

Moreover, the above has described the inkjet recording apparatus, but the scope of application of the present invention is not limited to this embodiment. The present invention can be applied to a photographic image forming apparatus which comprises a liquid ejection head for applying a developer to a printing paper without contacting with the printing paper. Furthermore, the scope of application of the present invention is not limited to the image forming apparatus, thus the present invention can be applied to various apparatuses (apparatuses for painting, applying, or wiring drawing) which use a liquid ejection head to eject treatment liquid and various other liquids to an ejection-receiving medium.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A method of manufacturing a liquid ejection head, the method comprising the steps of:

forming a plurality of piezoelectric elements on a diaphragm;

stacking an intermediate plate which includes recess sections for covering the piezoelectric elements and drive wires connected to the piezoelectric elements, on a surface of the diaphragm on which the piezoelectric elements are formed, in such a manner that peripheral spaces are formed around the piezoelectric elements by the recess sections and electrical connections are created between the drive wires and the piezoelectric elements;

connecting an integrated circuit to end sections of the drive wires which are opposite to connection sections between the drive wires and the piezoelectric elements;

forming an actuator function unit by electrically and mechanically bonding the diaphragm, the piezoelectric elements, the drive wires, the intermediate plate and the integrated circuit after the step of forming the piezoelectric elements on the diaphragm, the step of stacking the intermediate plate on the diaphragm, and the step of connecting the integrated circuit and the drive wires, in such a manner that the piezoelectric elements are electrically driven via the integrated circuit;

measuring displacement of the diaphragm by operating the integrated circuit in the actuator function unit; and bonding a flow path forming member to the actuator function unit after the step of measuring the displacement of the diaphragm, the flow path forming member being provided for forming a plurality of pressure chambers connected to a plurality of nozzles and forming a common liquid chamber for storing liquid supplied to the pressure chambers.

2. The method of manufacturing a liquid ejection head as defined in claim 1, wherein, the flow path forming member includes a pressure chamber forming member for forming the pressure chambers and a common liquid chamber forming member for forming the common liquid chamber; and the flow path forming member is bonded to the actuator function unit in such a manner that the pressure chamber forming member is bonded to a diaphragm side of the actuator function unit and the common liquid chamber forming member is bonded to an intermediate plate side of the actuator function unit.

3. The method of manufacturing a liquid ejection head as defined in claim 2, wherein the actuator function unit includes liquid flow paths penetrating through the intermediate plate and the diaphragm in such a manner that the pressure chambers are connected to the common liquid chamber via the liquid flow paths.

4. The method of manufacturing a liquid ejection head as defined in claim 2, the method further comprising the step of performing evaluation of a liquid sealing property of the actuator function unit by bringing the actuator function unit into contact with a conductive liquid, before the flow path forming member is bonded to the actuator function unit.

5. The method of manufacturing a liquid ejection head as defined in claim 1, the method further comprising the step of correcting at least one of a diameter of each of liquid droplet ejection ports and a diameter of each of liquid supply paths connected to the pressure chambers according to the measured displacement of the diaphragm.

6. The method of manufacturing a liquid ejection head as defined in claim 1, the method further comprising the step of correcting resistance values of the drive wires according to the measured displacement of the diaphragm.

* * * * *